US006087764A

United States Patent [19]

Matei

[11] Patent Number: 6,087,764

[45] Date of Patent: Jul. 11, 2000

[54] LIQUID-COOLED DISCHARGE LAMP

[75] Inventor: Silviu Matei, Malmö , Sweden

[73] Assignee: Tetra Laval Holdings & Finance S.A., Pully, Switzerland

[21] Appl. No.: 08/974,823

[22] Filed: Nov. 20, 1997

[30] Foreign Application Priority Data

Dec. 12, 1996 [SE] Sweden ..... 9604574

[51] Int. Cl.[7] ..... H01J 1/02; H01J 7/24; H01J 61/52; H01K 1/58

[52] U.S. Cl. ..... 313/22; 313/24; 313/26; 313/35; 313/36; 313/634

[58] Field of Search ..... 313/12, 17, 22–23, 313/24–26, 32, 35, 36, 493, 634, 573; 362/294, 318, 373, 96, 218, 267

[56] References Cited

U.S. PATENT DOCUMENTS

| | | | |
|---|---|---|---|
| 3,665,235 | 5/1972 | Hugot . | |
| 3,816,784 | 6/1974 | Weninger | 313/32 X |
| 3,994,686 | 11/1976 | Rauser et al. . | |
| 4,099,914 | 7/1978 | Gustafsson et al. . | |
| 4,994,705 | 2/1991 | Linder et al. . | |
| 5,451,367 | 9/1995 | Stark et al. . | |
| 5,504,666 | 4/1996 | Carmichael | 313/22 |

FOREIGN PATENT DOCUMENTS

| | | |
|---|---|---|
| 63-133443 | of 0000 | Japan . |
| 02078483 | 3/1990 | Japan . |
| 03163489 | 7/1991 | Japan . |
| 05101810 | 4/1993 | Japan . |
| 06215732 | 8/1994 | Japan . |
| 1294022A | of 0000 | United Kingdom . |

*Primary Examiner*—Nimeshkumar D. Patel
*Assistant Examiner*—Mack Haynes
*Attorney, Agent, or Firm*—Burns, Doane, Swecker & Mathis, L.L.P.

[57] ABSTRACT

Liquid-cooled discharge lamps of, for example, UV type are employed for sterilising objects, for example, packaging containers for foods. In lamps displaying a U-shaped luminant body and with a surrounding liquid container or envelope, cooling is improved according to the invention in that the base is provided with inflow and outflow channels for liquid, an inflow channel being directed towards the curved section of the luminant body. Whereby, cooling of the warmest section of the luminant body will be optimised, which results in a considerably lengthened service life for the lamp.

3 Claims, 1 Drawing Sheet

LIQUID-COOLED DISCHARGE LAMP

FIELD OF THE INVENTION

The present invention relates to a liquid-cooled discharge lamp with a base, a U-shaped luminant body and a surrounding liquid container or envelope.

BACKGROUND OF THE INVENTION

It is known in the art to employ various types of discharge lamps for sterilising objects or for reducing the number of living organisms in, for example, the packing of medical care instruments and utensils, or in the aseptic packing of foods. Such discharge lamps can, for example, in a uniform or pulsating flow, radiate UV light. In addition to light, such lamps generate heat which must be led off to prevent the lamps from deteriorating such that they give lower light efficiency or have shorter service life. This problem is normally solved by means of liquid cooling, i.e. a liquid—normally water—is caused to flow along the luminant parts of the lamp in order to cool them and keep the lamp at an acceptable working temperature. A particular problem in this context is discharge lamps of the type which include a curved, for instance U-shaped, luminant body. While such a configuration makes it possible, for example, to irradiate a partly finished packaging container interiorly, the U-shape of the luminant body gives a manifest thermal concentration at the curved section of the luminant body, which implies that this will operate at a relatively high working temperature even if the lamp is provided with liquid cooling. Conventional liquid cooling of this type of discharge lamp utilises a liquid container or envelope of, for example, quartz glass in which the luminant body is placed. Inflowing coolant is led by the intermediary of, for example, an insert along the luminant body so that the liquid flows along the one shank of the body, past the curved section and returns along the opposing shank of the luminant body. Since the temperature of the cooling water is at its lowest when it flows into the liquid container, this construction results in the one shank of the luminant body (more precisely at its starting end) having the most powerful cooling effect, while the cooling water will have been heated somewhat already on arrival at the curved section of the luminant body so that cooling of this section is not optimal.

There is thus a general need in the art to provide a liquid-cooled discharge lamp of the type which includes a curved or U-shaped luminant body, the discharge lamp having a cooling system adapted to the configuration of the luminant body which ensures that maximum cooling is obtained at the warmest site of the luminant body.

SUMMARY OF THE INVENTION

One object of the present invention is to realise a liquid-cooled discharge lamp of the type which includes a curved or U-shaped luminant body which does not suffer from the above-outlined drawbacks but displays optimum coolant flow, such that the efficiency and service life of the lamp are maximised.

A further object of the present invention is to realise a liquid-cooled discharge lamp with a U-shaped luminant body, in which the flow of the coolant is controlled such that maximum cooling is obtained at the warmest, curved section of the luminant body.

Yet a further object of the present invention is to realise a liquid-cooled discharge lamp with a U-shaped luminant body, in which the coolant is guided by means of channels and tubes such that cooling of the various parts of the luminant body is adapted to the level of heating during operation.

The above and other objects have been attained according to the present invention in that a liquid-cooled discharge lamp with a base, a U-shaped luminant body and surrounding liquid container or envelope has been given the characterizing feature that the base includes inflow and outflow channels for liquid, one inflow channel being directed towards the curved section of the luminant body.

Preferred embodiments of the discharge lamp according to the present invention have further been given the characterizing features as set forth in the appended subclaims.

By adapting and guiding the liquid flow so that cooling of the luminant body is modified to meet the relevant level of heating, the lamp according to the present invention will not only obtain maximum service life, but also optimum operating conditions, which ensures that the lamp, during the greater part of its service life, gives maximum destruction/sterilisation effect, which is essential in commercial applications in, for example, machines for packing foods.

BRIEF DESCRIPTION OF THE ACCOMPANYING DRAWING

One preferred embodiment of the lamp according to the present invention will now be described in greater detail hereinbelow, with particular reference to the accompanying Drawing which is schematic and shows only those parts and details indispensable to an understanding of the present invention. In the accompanying Drawing:

FIG. 1 is a side elevation of a discharge lamp according to the invention; and FIG. 2 is a section, on a larger scale, through the discharge lamp of FIG. 1.

DETAILED DESCRIPTION OF THE PREFERRED EMBODIMENTS

Figure 1:
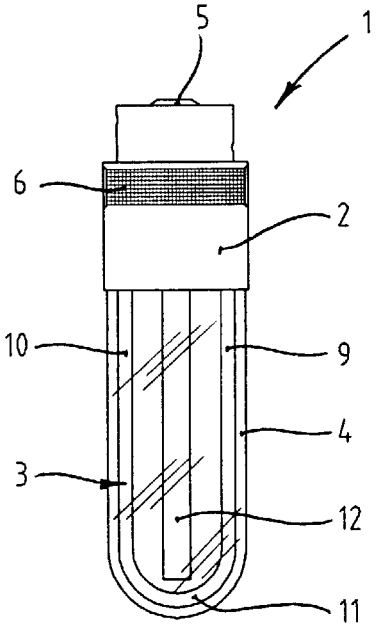

One preferred embodiment of a discharge lamp 1 according to the present invention is shown in FIG. 1. Naturally, discharge lamps may be of different designs and have different configurations, but a common feature for the discharge lamps according to the invention is that they include a base 2, a curved or U-shaped luminant body 3 and a liquid container or envelope 4 of, for example quartz glass surrounding the luminant body 3. As is apparent from FIG. 1, the lamp base 2 displays contactors 5, 6 for electric connection, which may naturally be designed in any optional manner. The base also includes (FIG. 2) an inlet and outlet 7', 8', respectively, for an inflow channel 7 and outflow channel 8 for coolant. The luminant body 3 is U-shaped and comprises two shanks 9 and 10 and an interjacent, curved section 11. Naturally, the luminant body may also have any other bent or curved configuration, for example V or Ω configuration, or include a plurality of curved sections. A tube 12 for coolant extends centrally between the shanks 9, 10 of the luminant body 3. The liquid container or envelope 4 is of substantially circular (or flattened circular) cross section and the tube 12 extends concentrically through the liquid container 4 in order to discharge in the immediate proximity of the curved section 11 of the luminant body 3.

Figure 2:
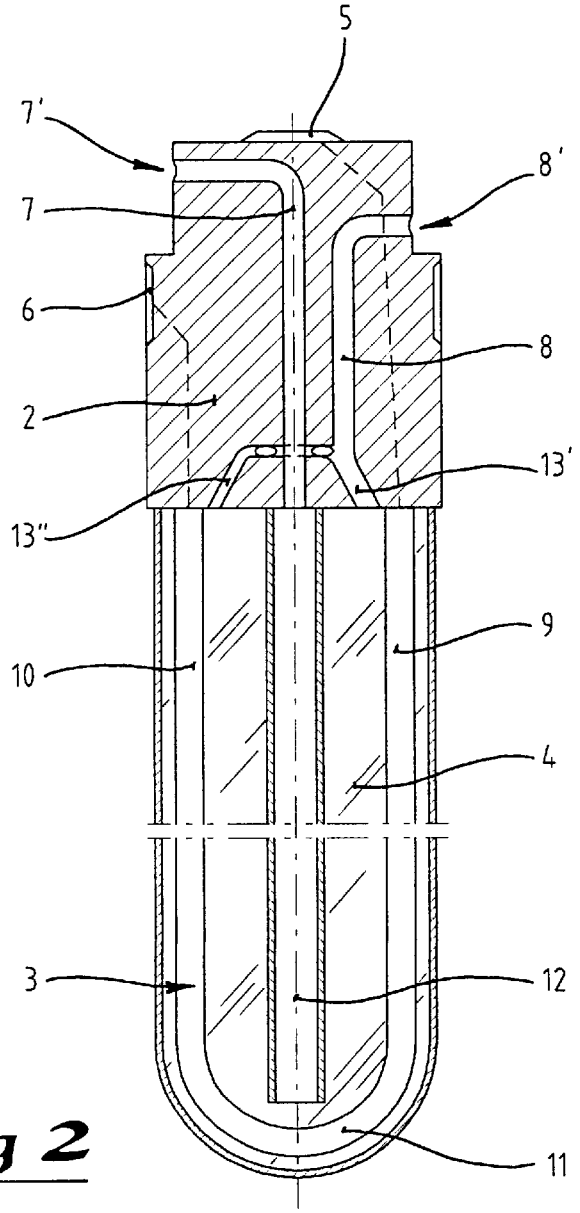

It will be apparent from FIG. 2 how the inflow channel 7 for coolant extends, from the inlet aperture 7' in the base 2 to the central portion of the base where it runs along the centre axis of the lamp 1 to the end of the base facing towards the luminant body 3. At this point, the inflow channel 7 merges into the tube 12 which, as was mentioned above, extends concentrically down through the liquid container 4 so that its lower, open end is directed towards the warmest, curved section 11 of the luminant body 3. The outflow channel 8 extends from the outlet aperture 8' in the base also vertically downwards to the base 2 of the lamp, but then splits into two branches 13 which discharge in that portion of the base which is turned to face towards the liquid container 4. Both branches 13' and 13" of the outflow channel 8 discharge more precisely in immediate conjunction with those portions of the shanks 9, 10 of the luminant body 3 which are secured in the base 2. The mouths of the outflow channel 8 or both branches 13', 13" in the base extend along lines which are directed towards the ends of the lamp shanks facing towards the base. Furthermore, both branches 13', 13" of the outflow channel 8 are of different cross sectional areas, the branch 13' of greater cross sectional area being placed in conjunction with the cathode side of the luminant body 3 and the branch 13" of smaller cross sectional area being placed at the anode side of the luminant body.

It will also be apparent from FIG. 2 how the contactors 5, 6 with leads disposed in the base 2 (indicated by broken lines) are connected to each respective shank 9, 10 of the luminant body 3.

On employment of the discharge lamp according to the invention for, for example, interior sterilisation of packaging containers, the discharge lamp 1 is inserted down into the packaging container and is activated for a sufficient period of time effectively to neutralise all living organisms located in the packaging container so that aseptic filling of the packaging container may thereafter be undertaken. In order to ensure that the lamp obtains the maximum service life and an as good as unchanged destruction effect throughout its service life, the lamp is cooled during operation with the aid of coolant, preferably de-ionised tap water. The water is led into the discharge lamp 1 via the inflow channel 7 in order, via the mouth of the tube 12, to flow out in a direction towards the warmest section of the luminant body 3, i.e. its lower, curved section 11. Since the mouth of the tube 12 is not only directed towards this section of the luminant body, but is also located in its immediate proximity, the cooling effect at the curved section 11 of the luminant body 3 will be maximal. The coolant flowing in to the liquid envelope or container 4 is thereafter forced upwards along both shanks 9, 10 of the luminant body 3 in order finally to flow out via the branches 13', 13" of the outflow channel 8 discharging in the liquid container 4. The placing and direction of these branches ensure that the coolant, before departing from the liquid container 4, flows in immediate conjunction with the parts of the shanks 9, 10 fixed in the base 2, which ensures that these components will also receive optimum cooling. As a result of the construction involving different cross sectional areas of the two branches 13', 13" of the outflow channel 8, it will further be ensured that the warmer cathode side (the shank 9) of the luminant body 3 is subjected to a greater flow than the somewhat cooler anode side, which further optimises the cooling of the luminant body 3 as a whole.

This effect is further amplified by the fact that both mouths of the outflow channel 8 extend along lines which are directed towards the securement ends of the shanks 9, 10.

As a result of the liquid-cooled discharge lamp constructed and designed according to the present invention, an adapted cooling will be ensured of the luminant body 3 so that the body will have a long service life. In addition, the risk of chemical change or degeneration of the warmest, curved section of the luminant body is avoided, which had previously been a problem since this, together with the accumulating coating on the inside of the luminant body had previously resulted in a progressively deteriorating light efficiency yield which, in practice reduced the practical service life of prior art lamps.

The present invention should not be considered as restricted to that described above and shown on the Drawing, many modifications being conceivable without departing from the scope of the appended claims.

What is claimed is:

1. A liquid-cooled discharge lamp comprising: a base, a U-shaped luminant body including two shanks secured to the base, and a surrounding liquid container or envelope, the base including an inflow and an outflow channel for a liquid, the inflow channel being directed towards a curved section of the luminant body, the outflow channel of the base including two branches, each branch having a mouth formed in the base, each mouth commencing in conjunction with the shanks of the luminant body (3).

2. The lamp as claimed in claim 1, wherein the mouths of the branches in the base extend along lines which are directed towards the ends of the luminant body shanks facing towards the base.

3. The lamp as claimed in claim 1, wherein a branch at a cathode side of the luminant body is of greater cross-sectional area than a branch at an anode side.

* * * * *